United States Patent [19]

Stubbings

[11] 4,210,090

[45] Jul. 1, 1980

[54] FORMATION OF RADIUS ELBOWS AND O.G. SETS

[75] Inventor: James H. Stubbings, Rockville, Md.

[73] Assignee: Potomac Applied Mechanics, Inc., Bethesda, Md.

[21] Appl. No.: 938,902

[22] Filed: Sep. 1, 1978

[51] Int. Cl.[2] ..... B21D 39/02

[52] U.S. Cl. ..... 113/54 R; 29/781; 72/52

[58] Field of Search ..... 72/51, 52, 181; 113/1 N, 54, 58, 110 UT; 29/781, 788, 789, 819

[56] References Cited

U.S. PATENT DOCUMENTS

| | | | |
|---|---|---|---|
| 2,621,621 | 12/1952 | Kaiser | 113/58 |
| 2,696,182 | 12/1954 | Hoenninger et al. | 72/51 |
| 2,950,697 | 8/1960 | Flaglen | 29/781 |
| 3,015,293 | 1/1962 | Porham | 113/54 |
| 3,321,945 | 5/1967 | Grote | 113/54 X |
| 3,407,640 | 10/1968 | Lipp | 113/54 X |
| 3,421,356 | 1/1969 | Bieske | 113/54 X |
| 3,422,525 | 1/1969 | Jeppseon | 113/54 X |
| 3,473,291 | 10/1969 | Raymond | 93/82 X |
| 3,636,903 | 1/1972 | Anderson et al. | 113/54 |
| 3,722,443 | 3/1973 | Andersen et al. | 113/54 |
| 3,840,960 | 10/1974 | Toti | 29/779 X |
| 3,901,174 | 8/1975 | Priest | 113/54 |
| 4,048,825 | 7/1977 | Dostrup | 72/12 |

*Primary Examiner*—Leon Gilden

*Attorney, Agent, or Firm*—Cushman, Darby & Cushman

[57] ABSTRACT

A machine for automatically assembling radius elbows and/or O.G. sets, and the method of utilization of the machine. Four edge deformation effecting components, such as Pittsburg rollers or air hammers, are provided for interlocking edge configurations of ducts to be formed, the edge deformation components defining the corners of a vertical quadrate opening. Two of the components are mounted at the same vertical height above a fabrication table for movement relative to each other in a horizontal direction perpendicular to the horizontal direction of feed of duct pieces through the quadrate opening defined by the edge deforming components. The other two edge deformation components are located at substantially the same level as the rollers of the fabrication table, rollers of the fabrication table being disposed on either side of the vertical plane containing the four edge deformation components. The mounts for the edge deformation components are rotatable about vertical axes to accommodate O.G. sets, when being formed, and the maximum horizontal spacing between the components of the respective pairs of edge deformation components is less than the length of the rollers of the fabrication table.

15 Claims, 6 Drawing Figures

FORMATION OF RADIUS ELBOWS AND O.G. SETS

BACKGROUND AND SUMMARY OF THE INVENTION

The invention relates to the automatic, or semiautomatic, formation of radius elbow and O.G. set ducts. In the sheet metal trade today, after formation of duct work pieces for radius elbows and O.G. sets, the pieces are edge interlocked together by hand, by a worker running up and down each of the edge configurations to be interlocked, utilizing a power tool, hammer, or the like. Such a method of assembly is relatively time consuming and inefficient, therefore there is the need for a mechanism, and method of operation thereof, which can effect automatic or semiautomatic closure of the edge configurations of radius elbows and O.G. sets. An automatic and a semiautomatic, assembly for the closing of edge configurations of straight duct and transitions is disclosed in my copending application Ser. No. 788,641, filed Apr. 18, 1977 (now U.S. Pat. No. 4,111,143). Heretofore, however, there has been no such arrangement capable of automatic or semiautomatic formation of radius elbows and O.G. sets from duct work pieces.

According to the present invention, a method is provided for formation of radius elbow ducts, and O.G. set ducts, automatically using an edge interlocking machine having automatic edge interlocking components. First, a plurality of duct work pieces are formed out of sheet material, each piece having a predetermined length, and curved edges. At least one of the pieces (and preferably all of the pieces) are formed so that it has an edge configuration adapted to be acted upon to interlock and form a seam with another piece to form the duct. The plurality of pieces are initially placed together to be acted upon by the automatic edge interlocking components, and then the pieces are fed into the edge interlocking components in a general direction H, the automatic edge interlocking components acting on the edge configurations of the pieces to interlock all edge configurations together to form seams of a completed radius elbow, or O.G. set, duct.

The machine according to the present invention for automatically assembling radius elbows and/or O.G. sets comprises a plurality of edge deformation effecting components, each component comprising means for effecting deformation of edge portions of duct work by bending over an upstanding edge portion of an edge configuration. Four edge deformation effecting components preferably are provided, mounted so that they define the corners of a vertical quadrate opening. First mounting means are provided for mounting two of the components at substantially the same vertical height and for movement relative to each other along a horizontal direction P, perpendicular to the horizontal direction of feed H of duct work pieces through the edge interlocking components. A fabrication table is disposed below the two components mounted by the first mounting means, which table extends substantially horizontally and includes a plurality of rollers mounted for rotation about horizontal axes generally parallel to the horizontal direction P; rollers of the fabrication table are disposed on both sides of a vertical plane contaning the first mounting means, so that the duct pieces are supported on either side of the edge inerlocking components. Pivotal mounting means are provided for mounting the components so that they are pivotal about parallel vertical axes with respect to the mounting means therefor. Means are also provided for moving the components relative to each other in the horizontal direction P, and for moving the mounting means to change the vertical position of the mounting means with respect to the fabrication table. The components are movable to a maximum horizontal spacing with respect to each other along the direction P, and the rollers of the fabrication table have a length longer than the maximum horizontal spacing to which the components are movable.

It is a primary object of the present invention to provide for the automatic, or semiautomatic, assemblage of radius elbow and/or O.G. set ducts. This and other objects of the invention will become clear from an inspection of the detailed description of the invention, and from the appended claims.

DETAILED DESCRIPTION OF THE DRAWINGS

Figure 1:
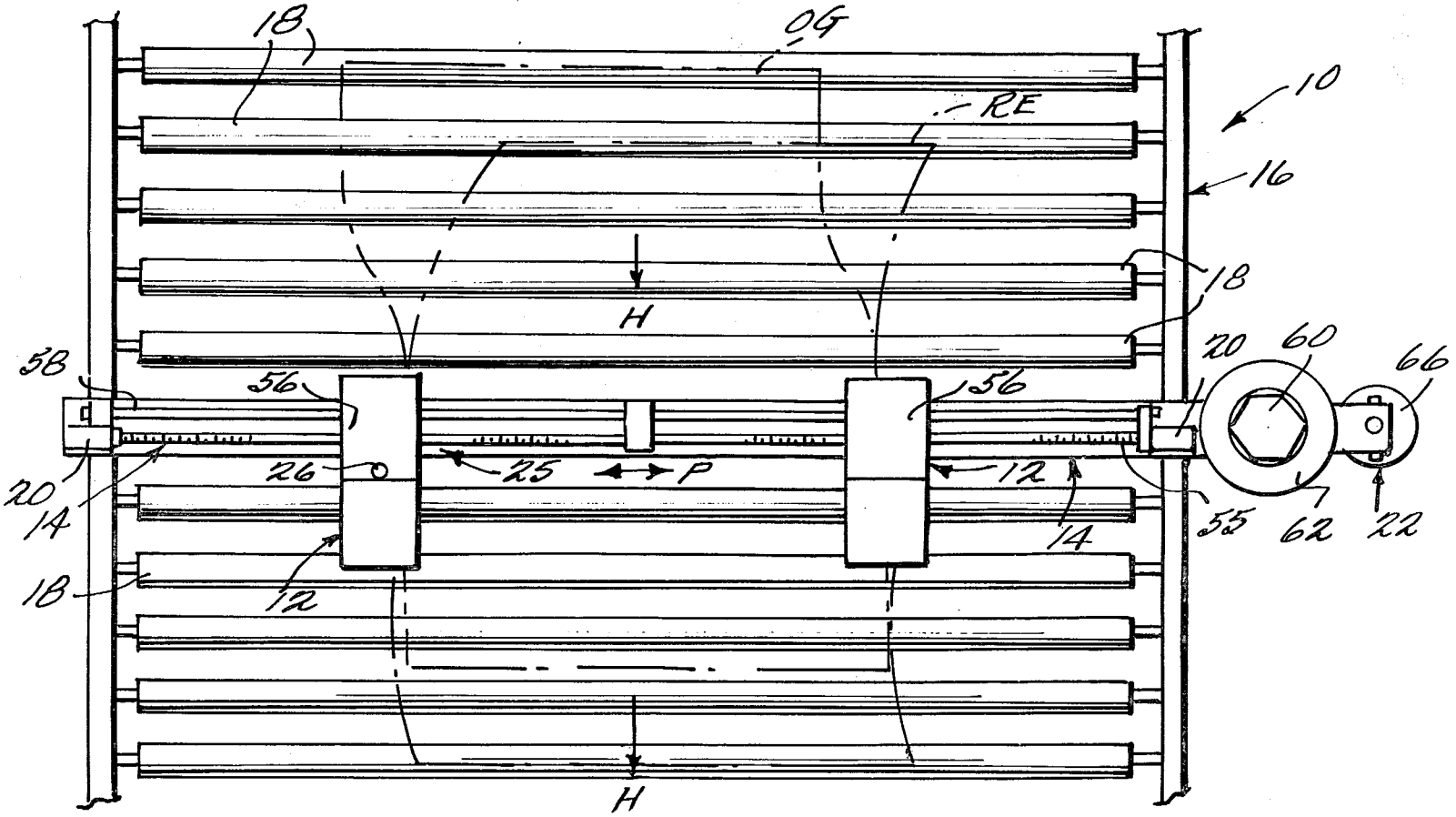
FIG. 1 is a top plan view of an exemplary machine according to the present invention, showing top plan views of an O.G. set and a radius elbow, in dotted line, that may be formed therewith.

A machine for automatically assembling radius elbows RE and/or O.G. sets OG according to the present invention is shown generally at 10 in the drawings. The machine 10 includes a plurality of edge deformation effecting components 12, each component comprising means for effecting deformation of edge portions of duct work by bending over an upstanding edge portion F (see FIG. 2 in particular) of an edge configuration E of duct being formed. First mounting means 14 preferably are provided for mounting two of the components 12 at substantially the same vertical height (see FIGS. 2 and 4 in particular) and for movement relative to each other along a horizontal direction P. Preferably, four edge deformation effecting components are provided, mounted so that they define the corners of a vertical quadrate opening (see FIGS. 2 and 4 in particular).

A fabrication table 16 is provided below the components 12 mounted by the first mounting means 14, the table 16 extending substantially horizontal and including a plurality of rollers 18 mounted for rotation about horizontal axes generally parallel to the horizontal direction P, rollers 18 of the fabrication table 16 being disposed on both sides of a vertical plane containing the first mounting means 14 (see FIG. 1). Second mounting means 14' are provided for mounting two of the components 12 at substantially the same height as the plurality of rollers 18, also for movemet relative to each other along direction P, and synchronized movement in direction P with the corresponding components 12 mounted by the first mounting means 14.

Means 20, 20'are provided for moving the components 12 relative to each other in the horizontal direction P, and means 22 are provided for moving the first mounting means 14 to change the vertical position of the mounting means 14 with respect to the fabrication table 16. The components 12 are movable to a maximum horizontal spacing L' (see FIG. 2) with respect to each other (the maximum horizontal spacing of the vertical quadrate opening defined by the components 12), the length L' being shorter than the effective horizontal length L (see FIG. 2) of the rollers 18 of the fabrication table 16. These relative dimensions are provided to allow the complete movement of a radius elbow or O.G. set, which will have curvature in the horizontal plane in the direction H in which they are fed through the machine 10 (see FIG. 1), so that the entire duct structure can be supported during the entire length of movement by the rollers 18.

Third mounting means, 25, which comprise pivotal mounting means, are provided for mounting each of the components 12 for rotation about a vertical axis 26, such pivotal movement being necessary in order to accommodate the curvature of O.G. set ducts when such duct components are moving through the machine 10. Means are also provided for locking the third mounting means 25 to prevent rotation of the components 12 mounted thereby about the vertical axis 26, prevention of rotation thereof about axis 26 being provided when radius elbows RE are being fabricated by the machine 10. Such locking means may take a wide variety of forms. One such form is illustrated most clearly in FIG. 5 wherein blocks of material 28 are disposed on either side of the axis 26, preventing movement of a support gusset 30 for components 12 with respect to a stationary mount with which the axis 26 cooperates, the blocks 28 being removable when desired.

Figure 2:
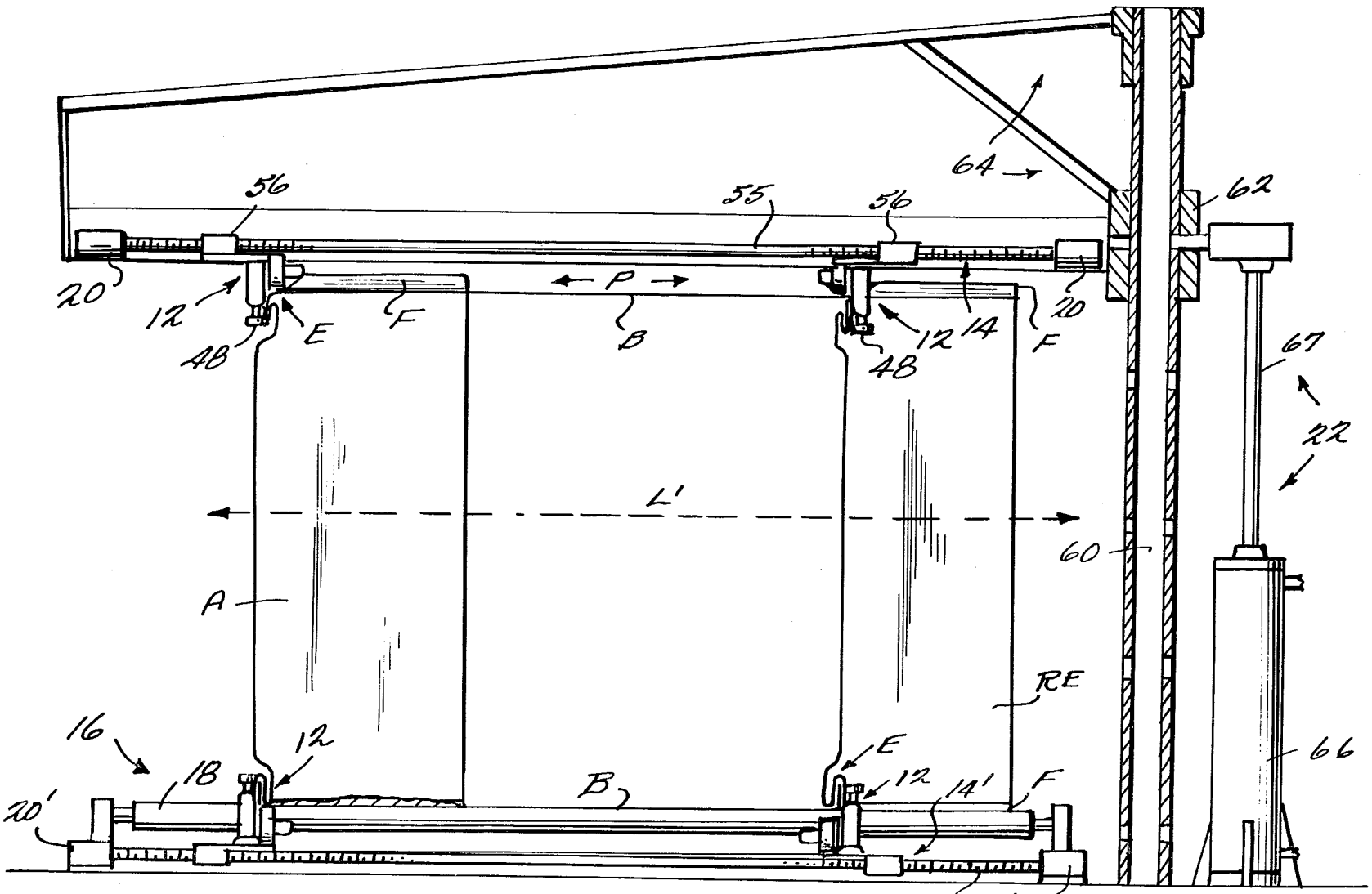
FIG. 2 is a front view, with the front portions of the fabrication table removed for clarity, of the machine of FIG. 1.
Figure 3:
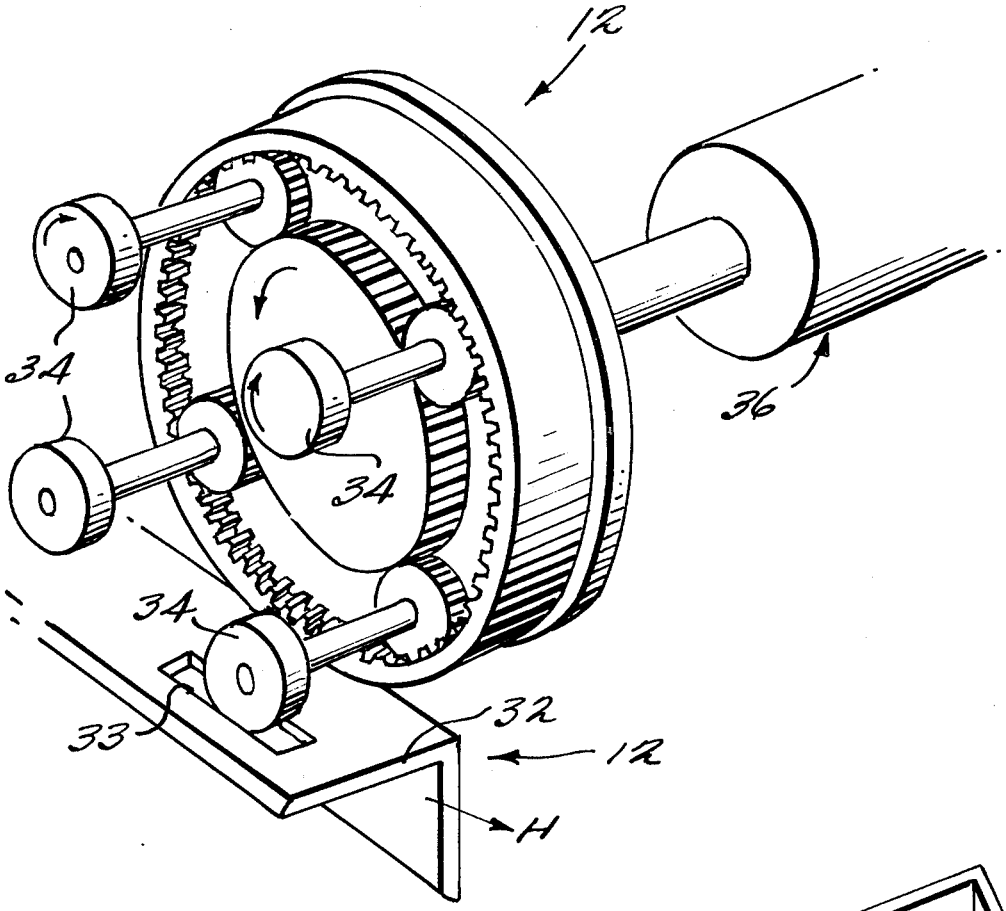
FIG. 3 is a detail perspective view of one embodiment of exemplary edge deformation effecting components that may be utilized according to the invention.
Figure 6:
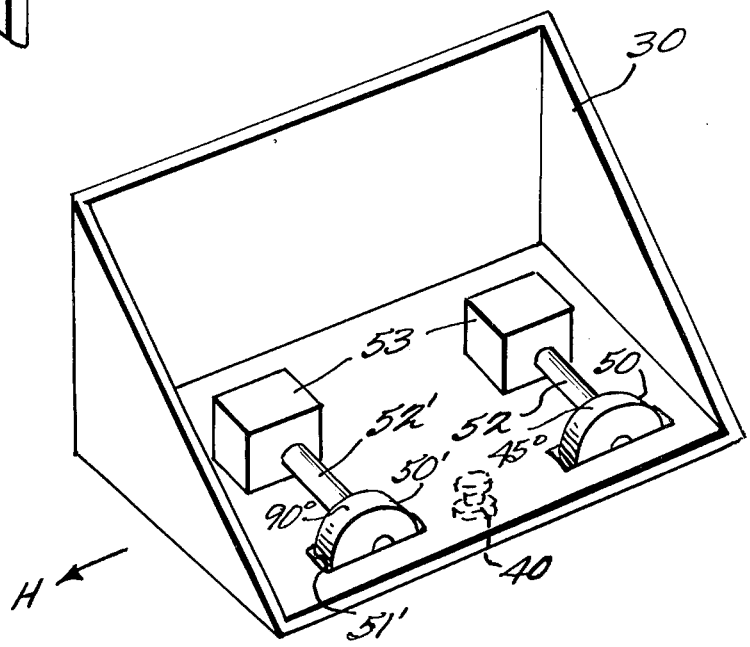
FIG. 6 is a detail perspective view of another exemplary edge interlocking component embodiment according to the invention.
Figure 5:
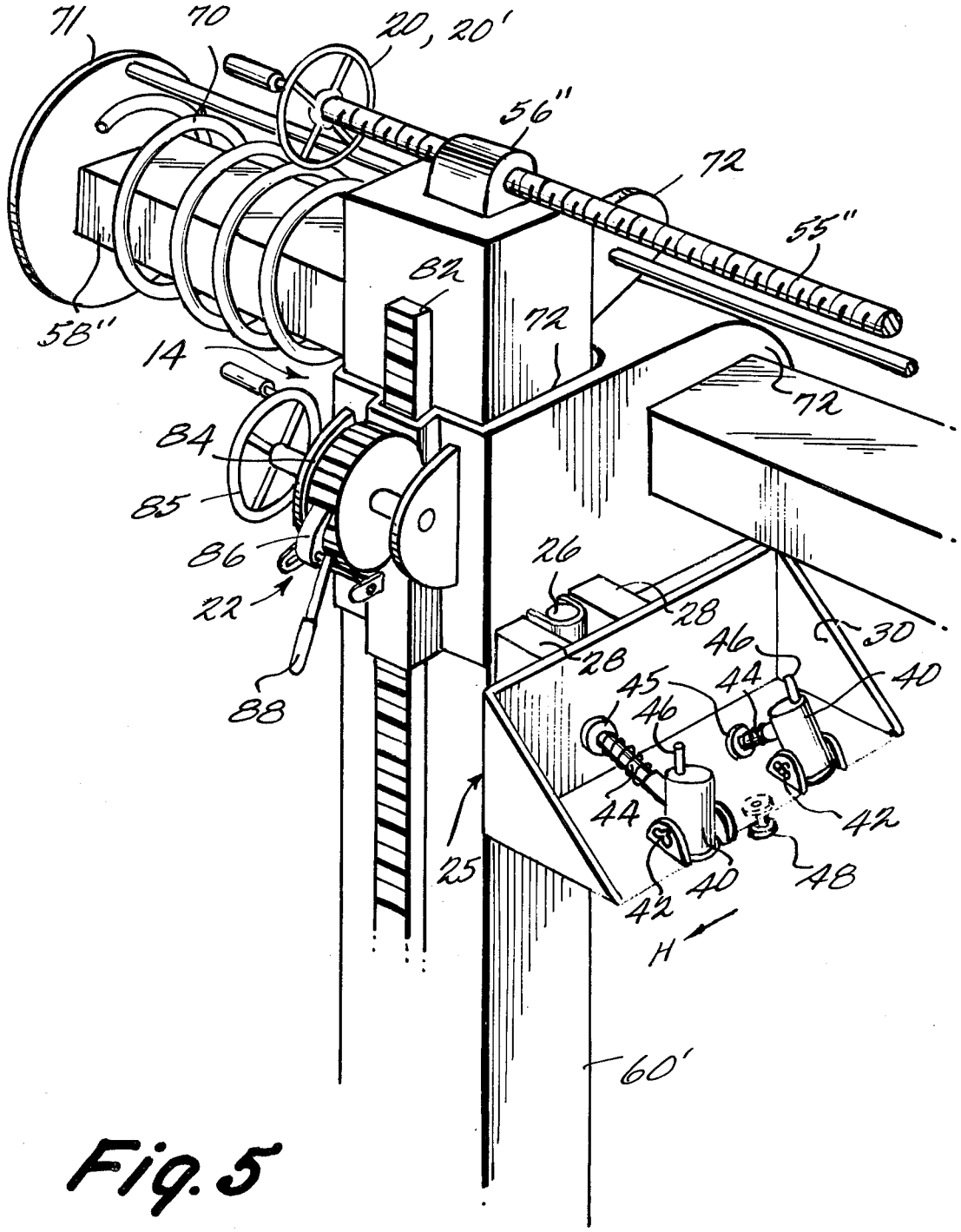
FIG. 5 is a detail perspective view of one edge interlocking component assembly of the FIG. 4 embodiment.

Three exemplary forms that the edge deformation components 12 may take are shown schematically in FIGS. 3, 5, and 6. In the FIG. 3 embodiment, a plurality of edge deforming rollers 34, each of different configuration, are provided, the rollers 34 acting through an opening 33 provided in an angular guide component 32 for the duct being formed, and rotatable in the senses indicated by the arrows in FIG. 3, with respect to the direction of feed H. First means 36, such as an electric motor and a ring gear, are provided for rotating the rollers sequentially into engagement with the duct work, and second means 38, such as planet gears associated with the rollers 34 and a sun gear driven by the electric motor, are provided for rotating the rollers 34 with respect to the first means 36. In the embodiment shown in FIG. 5, the components 12 comprise a pair of air hammers 40, being mounted by mounts 42, adjustable rods 44, and securing components 45 (such as suction cups) so that they are disposed at different angular positions with respect to the upstanding portion F of the edge configuration E of the duct being fed therethrough—that is, the first hammer 40 is disposed at a 45° angle with respect to the vertical, and the second hammer 40 is disposed substantially at 0° with respect to the vertical. Sources of supply fluid are connected up to portions 46 of the hammers 40, and a guide roller 48, rotatable about a vertical axis, is associated with the gusset 30 mounting the components 12, which roller 48 engages a side of the duct being fed through the edge components, as shown in FIG. 2. The edge configuration E preferably is a pittsburg edge configuration, although other suitable conventional edge configurations can be provided.

The embodiment of the exemplary component 12 shown in FIG. 6 comprises a plurality of rollers 50, 50'disposed in line in the horizontal direction H. Any number of rollers can be provided, having the different surface configurations necessary to effect deformation of the edge component. For instance, the first roller 50 has a 45° angular configuration of the surfaces thereof, and the second roller 50' has a 90° surface configuration. The rollers 50, 50' extend through openings 51, 51' respectively in the gusset 30 for engaging the upstanding edge portion F of the edge configuration E, and are rotatable by shafts 52, 52' driven by suitable power sources 53. A guide roller 48, properly positioned, is also provided.

Figure 4:
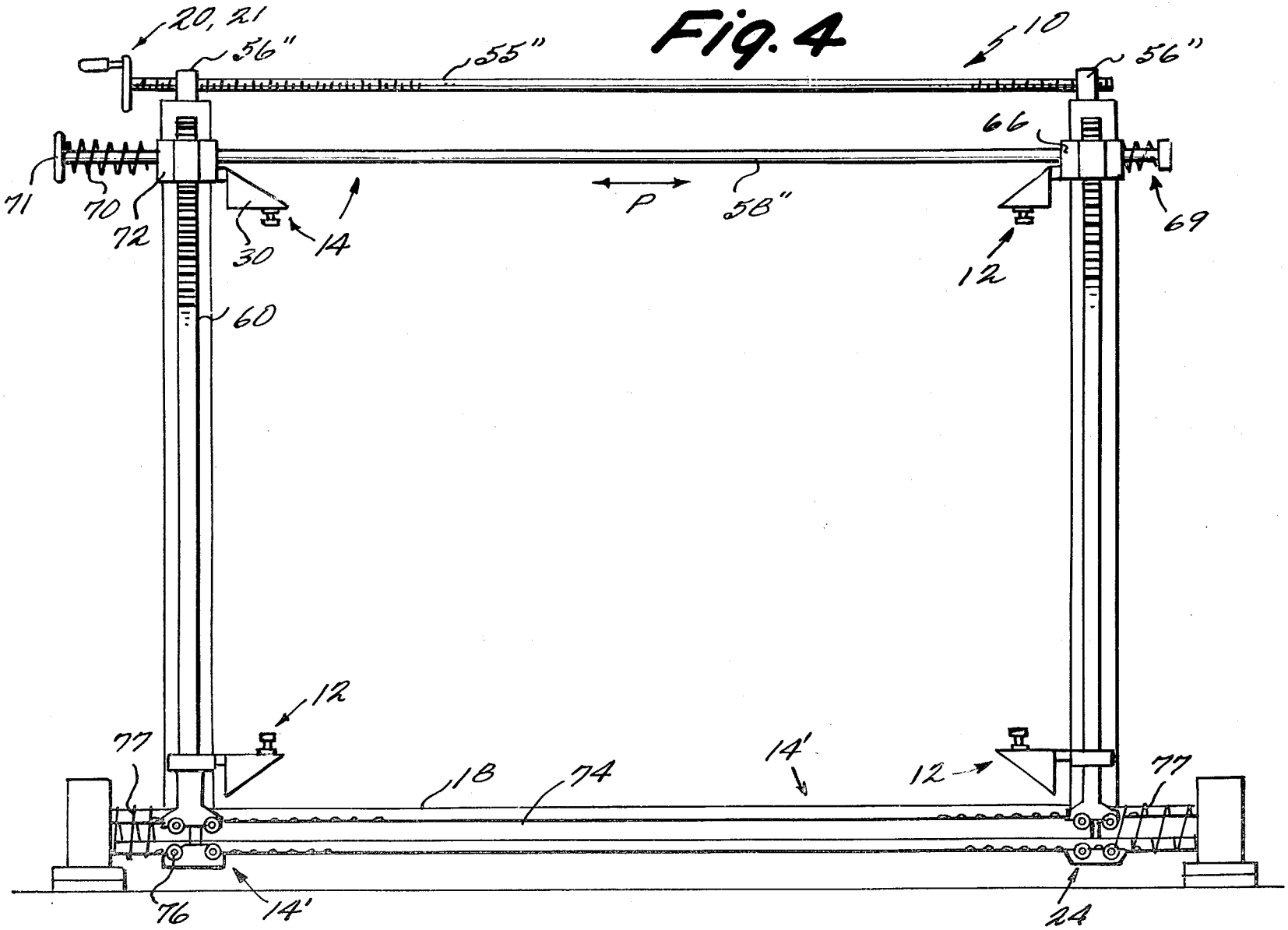
FIG. 4 is a front view, with the front portion of the fabrication table removed for clarity, of another embodiment of an exemplary machine according to the invention.

The embodiment of the machine 10 shown in FIGS. 1 and 2 is adapted for automatic adjustment of the size of the quadrate opening defined by the components 12, while the embodiment illustrated in FIGS. 4 and 5 is adapted for manual adjustment.

The first mounting means 13 of the FIG. 1 and 2 embodiment preferably comprises a lead screw 55 passing through traveling nuts 56 which are operatively mounted to the respective components 12, and a suitable guide rod 58 assembly being provided for guiding movement of the nuts 56 in direction P. The means 20 comprise electric motors, or like power means, for rotating the lead screw 55, rotation of the lead screw 55 being transformed into linear movement in direction P of the components 12 by the traveling nuts 56. For the second mounting means 14', similar components 55'and 56' are provided (as well as a guide rod corresponding to guide rod 58, which guide rod is not shown). Also, in the FIG. 1 and 2 embodiment, the means 22 for moving the first mounting means 14 to change the vertical position thereof with respect to the fabrication table 16 comprises a vertically extending support rod 60 (which may be a polygon in cross-section if desired in order to eliminate any pivotal movement with respect thereto), a sleeve 62 receiving the rod 60, a cantilever assembly 64 for mounting the first mounting means 14 to the sleeve 62, and power means for moving the sleeve 62 along the rod 60, such power means being shown as a hydraulic or pneumatic cylinder 66 with cooperable piston rod 67 in FIGS. 1 and 2. Of course instead of a single shaft 60 and sleeve bearing 62, a dual arrangement could be provided, a rod 60 and sleeve 62 being disposed on either side of the quadrate opening defined by the components 12, and another power means may be provided also if desired. Additionally, a suitable common control may be provided for synchronizing the movements of the motors 20, 20' and the cylinder 66 (as well as the power means associated with the components 12, if desired) so that the predetermined spacing of components may be provided by a single control, not requiring the operator adjustment. Such a coordinating control is shown in box form at 68 in FIG. 2, and may comprise a suitable industrial computer, or the like.

In the FIGS. 4 and 5 embodiment, the first mounting means 14 preferably comprises a lead screw 55", a traveling nut 56" cooperating therewith, and a guide structure 58"for guiding the movement of the components 12 in direction P. The guide structure 58" preferably comprises a tube that has a polygon cross-section, and in order to ensure that the components associated with lead screws 56'' are maintained in the positions to which they are adjusted, a spring means 69 preferably is provided, which includes a spring 70 extending around the member 58'' and abutting an end disc 71 of the member 58'', and a portion of a guide collar 72 associated with the gusset 30 mounting structure. A pair of vertical support rods 60' are provided, and the means for effecting movement of the first and second mounting means 14, 14' comprises the same component —a hand wheel 20, 20' associated with the lead screw 55''. The second mounting means 14' may comprise a rack 74 with a traversing structure 76 associated with each rod 60', and with the rack 74, spring menas 77 providing for bias of the structure 76.

The means 22 of the FIGS. 4 and 5 embodiment (as shown in FIG. 5) may comprise a suitable hand operated structure allowing adjustment of the vertical position of each bracket 72 with respect to its corresponding rod 60'. One such suitable means includes a rack 82, a pinion 84 operatively mounted to the bracket 72, a hand wheel 85 for rotating the pinion 84, a pawl assembly 86, which may be switched over to allow rotation of the pinion 84 in either angular direction, and a control 88 for the pawl assembly 86. The pawl assembly 86 and release 88 are shown only schematically in FIG. 5, and may comprise any suitable conventional components for effecting the desired results.

An exemplary machine 10 according to the present invention having been described, now the exemplary manner of utilization thereof for practicing a method for forming radius elbow and/or O.G. set ducts, will now be set forth, with particular reference to FIGS. 1 and 2.

A plurality of duct work pieces A, B are formed out of sheet material, each piece having a predetermined length and having curved edges, the curvature being provided so as to form a radius elbow RE, or an O.G. set OG. At least one of the pieces A, B, is formed so that it has an edge configuration E adapted to be acted upon by the edge interlocking components 12 of the machine 10 to form a seam with another piece A, B to form the duct. Preferably, as shown in FIG. 2, all four pieces A, B have edge configurations that will cooperate with components 12, such as the pittsburg edge configurations shown in FIG. 2, with upstanding portions F of the pieces A being bent over into abutting engagement with the surfaces of the components B. In circumstances where only one or two edge configurations are provided, only the top components 12, associated with the first mounting means 14, need be provided, and the lower components 12 associated with the second mounting means 14'may be replaced by suitable guide rollers having surface characteristics adapted to positively hold the duct in place during edge deformation. The pieces A, B, are initially placed together in position to be acted upon by the automatic edge interlocking component 12 (see FIG. 2), as by hand, and then the radius elbow RE or O.G. set OG is placed on the rollers 18 of the fabrication table 16 on the inlet side (with respect to feed direction H) of the quadrate opening defined by the components 12.

After proper positioning of the radius elbow RE or O.G. set OG, the locking means 28 are either activated or removed to either prevent or allow pivotal movement of the components 12 about vertical axes 26, depending upon whether a radius elbow RE or O.G. set OG, respectively, is being formed. Then the plurality of pieces A, B, are fed (as by an operator pushing them, or by powering of the rolls 18 in synchronization with the power components of the edge interlocking components 12) in the direction H, the positions of the components 12 both vertically and horizontally (in direction P) having been properly determined by the moving means 20, 22. During feeding of the pieces A, B, in direction H, while the pieces are being supported by the rollers 18 on either side of the vertical plane containing the first and second mounting means 14, 14' the edge interlocking components 12 act on the edge configurations E to interlock the edge configurations together to form seams of a completed radius elbow or O.G. set duct. In FIG. 2 a radius elbow RE is shown being moved through the machine 10, the radius elbow RE having a Pittsburgh edge configuration and the components 12 deforming the upstanding portions F of the pieces A so that they abut and hold the pieces B in operative association with the pieces A.

It will thus be seen that according to the present invention a method and machine have been provided which allow the automatic or semiautomatic formation of radius elbow and O.G. set ducts. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and devices.

I claim:

1. A machine for automatically assemblying radius elbow and/or O.G. set ducts, comprising (a) four edge deformation effecting components for interlocking edge configurations of the ducts to be formed, (b) first mounting means for mounting said edge deformation effecting components so that they define the corners of a vertical quadrate opening, (c) pivotal movement mounting means for mounting said components so that they are pivotal about parallel vertical axes with respect to said first mounting means, and (d) means for moving said components with respect to each other so that the horizontal and vertical spacings therebetween may be modified.

2. A machine as recited in claim 1 further comprising means for locking said pivotal movement mounting means to prevent rotation of said components mounted thereby about said vertical axes.

3. A machine as recited in claim 1 further comprising a fabrication table which extends horizontally through to both sides of the vertical quadrate opening, said fabrication table including a plurality of rollers mounted for rotation about horizontal axes generally perpendicular to the direction of extension of said fabrication table.

4. A machine as recited in claim 1 or claim wherein said edge deformation effecting components each comprise a plurality of edge deforming rollers each of different configuration, first means for rotating said rollers sequentially into engagement with duct work to be engaged thereby, and second means for rotating said rollers with respect to said first means.

5. A machine as recited in claim 1 or claim wherein said edge deformation effecting components each comprise a plurality of air hammers, each air hammer of each component extending at a different angular position with respect to the vertical.

6. A machine as recited in claim 1 or claim wherein said edge deformation effecting components each comprise a plurality of rollers disposed in line in a horizontal direction H perpendicular to said direction P.

7. A machine as recited in claim 1 or claim wherein said first mounting means includes a bracket, and a traveling nut operatively mounted to said bracket and receiving a lead screw in operative association therewith.

8. A machine as recited in claim 7 further comprising a guide roller, for engaging the side of a duct being formed, mounted with each bracket, and rotatable about a vertical axis.

9. A machine for automatically assembling radius elbow and/or O.G. set ducts, comprising (a) a plurality of edge deformation effecting components, each component comprising means for effecting deformation of edge portions of duct work by bending over an upstanding edge portion of an edge configuration, (b) first mounting means for mounting two of said components at substantially the same vertical height and for movement relative to each other along a horizontal direction P, (c) a fabrication table below said two components mounted by said first mounting means, which table extends substantially horizontally and includes a plurality of rollers mounted for rotation about horizontal axes generally parallel to said horizontal direction P, rollers of said fabrication table being disposed on both sides of a vertical plane containing said first mounting means, (d) means for moving said components relative to each other in said horizontal direction P, and means for moving said first mounting means to change the vertical position of said mounting means with respect to said fabrication table, said components being movable to a maximum horizontal spacing with respect to each other along said direction P, and (e) said rollers of said fabrication table having a length longer than the maximum horizontal spacing to which said components are movable.

10. A machine as recited in claim 9 further comprising second mounting means for mounting two of said components at substantially the same vertical height as said plurality of rollers and for movement relative to each other along said horizontal direction P, said first and second mounting means being substantially disposed in a common vertical plane, and means for moving said components mounted by said second mounting means relative to each other.

11. A machine as recited in claim 10 further comprising means for synchronizing the operation of said means for moving said components associated with said first and second mounting means with respect to each other.

12. A machine as recited in claim 9 or claim 9 further comprising third mounting means for mounting each of said components for rotation about a vertical axis.

13. A machine as recited in claim 12 further comprising means for locking said third mounting means to prevent rotation of the components mounted thereby about a vertical axis.

14. A machine as recited in claim 9 wherein said means for moving said components relative to each other comprises a lead screw, a manual actuator for said lead screw, means for transforming rotation of said lead screw into linear movement of said components, a guide rod, collar means receiving said guide rod and operatively connected to said transforming means, and spring means for biasing said collar means.

15. A machine as recited in claim 9 wherein said means for moving said mounting meansto change the vertical position thereof comprises a vertically extending rod, a sleeve receiving said rod, a cantilever assembly mounting said first mounting means to said sleeve, and power means for moving said sleeve along said rod.

* * * * *